US009926126B2

(12) United States Patent
Blanchette et al.

(10) Patent No.: US 9,926,126 B2
(45) Date of Patent: Mar. 27, 2018

(54) PACKAGE CONFIGURATION FOR EMPTY SHEET-FORMED CONTAINERS

(71) Applicant: PACTIV CANADA INC., Scarborough (CA)

(72) Inventors: François Blanchette, Mirabel (CA); François St-Louis, Sainte-Julie (CA); Germain Archambault, Saint-Hubert (CA)

(73) Assignee: PACTIV CANADA INC., Ontario (CA)

( * ) Notice: Subject to any disclaimer, the term of this patent is extended or adjusted under 35 U.S.C. 154(b) by 850 days.

(21) Appl. No.: 13/677,792

(22) Filed: Nov. 15, 2012

(65) Prior Publication Data

US 2014/0131243 A1 May 15, 2014

(51) Int. Cl.

| | |
|---|---|
| ***B65D 5/36*** | (2006.01) |
| ***B65D 81/02*** | (2006.01) |
| ***B65D 71/00*** | (2006.01) |
| ***B65D 85/32*** | (2006.01) |

(52) U.S. Cl.

CPC ..... *B65D 81/025* (2013.01); *B65D 71/0096* (2013.01); *B65D 85/32* (2013.01); *B65D 2571/00055* (2013.01); *B65D 2571/00061* (2013.01); *B65D 2571/00074* (2013.01)

(58) Field of Classification Search

CPC ..... B65D 85/62; B65D 2571/00055; B65D 2571/00037; B65D 2571/00018; B65D 2571/00074

USPC ..... 206/386, 597, 598, 599, 600, 499, 500, 206/511, 512; 229/915; 108/51.3, 53.1, 108/53.5, 14, 25

See application file for complete search history.

(56) References Cited

U.S. PATENT DOCUMENTS

| | | | | | |
|---|---|---|---|---|---|
| 2,719,664 | A | * | 10/1955 | Hester | 229/120.01 |
| 3,272,328 | A | * | 9/1966 | Krzyzanowski | 206/482 |
| 3,712,532 | A | * | 1/1973 | Alroy | 206/521.1 |
| 4,151,948 | A | * | 5/1979 | de la Fuente, Jr. | 206/512 |
| 4,182,244 | A | * | 1/1980 | Hutchins et al. | 108/91 |
| 4,244,472 | A | * | 1/1981 | Brown | 206/597 |
| 5,145,060 | A | * | 9/1992 | Maye | 206/763 |
| 5,205,410 | A | * | 4/1993 | Kuipers et al. | 206/386 |
| 5,251,753 | A | * | 10/1993 | Pigott et al. | 206/766 |
| 5,275,289 | A | * | 1/1994 | Blatt | 206/513 |
| 5,307,928 | A | * | 5/1994 | Bishop | 206/320 |
| 5,694,836 | A | * | 12/1997 | Blevins | 99/517 |

(Continued)

*Primary Examiner* — Jacob K Ackun

(74) *Attorney, Agent, or Firm* — Baker Botts L.L.P.

(57) ABSTRACT

Package includes stacks of empty containers matingly stacked, panels each having a main surface with peripheral walls, and support members. A first level includes a first panel, one or more stacks of egg containers laid horizontally on the main surface of the first panels within the peripheral walls, and said support members extending from the first panel to a top of the first level. A second level includes a second panel laid on the first level in contact with the support members, one or more stacks of containers laid horizontally on a surface of the second panel within the peripheral walls, and support members extending from the second panel to a top of the second level. A panel is disposed on an uppermost level and having its peripheral walls covering a top of the sides of the uppermost level and in contact with the support members of the uppermost level.

20 Claims, 6 Drawing Sheets

(56) References Cited

U.S. PATENT DOCUMENTS

| | | | | |
|---|---|---|---|---|
| 5,950,911 | A * | 9/1999 | Naughton et al. | 229/109 |
| 6,012,583 | A * | 1/2000 | Ramirez | 206/521.1 |
| 6,267,255 | B1 * | 7/2001 | Brush | 211/59.4 |
| 6,488,200 | B1 * | 12/2002 | Jensen, Jr. | 229/122.3 |
| 6,502,698 | B1 * | 1/2003 | McKenna et al. | 206/509 |
| 6,527,114 | B2 * | 3/2003 | Bishop et al. | 206/321 |
| 2005/0011798 | A1 * | 1/2005 | Nelson et al. | 206/499 |
| 2005/0092637 | A1 * | 5/2005 | Baechle et al. | 206/386 |
| 2006/0175227 | A1 * | 8/2006 | Lau | 206/600 |
| 2007/0006783 | A1 * | 1/2007 | Braun et al. | 108/53.1 |
| 2007/0017843 | A1 * | 1/2007 | Keel et al. | 206/509 |
| 2013/0183412 | A1 * | 7/2013 | Ramirez et al. | 426/119 |

* cited by examiner

PACKAGE CONFIGURATION FOR EMPTY SHEET-FORMED CONTAINERS

FIELD OF THE APPLICATION

The present application relates to containers for receiving frangible objects such as eggs and other frangible objects, and to the bulk shipping of such containers before their use.

BACKGROUND OF THE ART

Egg containers of various kinds have been developed for the transportation and sale of eggs. As eggs are relatively fragile, the egg containers must protect the eggs from the various manipulations involved from the packaging of the eggs to the consumer's refrigerator. One significant improvement in egg containers is the use of thermoformed plastics as material for the egg containers. Thermoformed plastics are typically transparent, which allows the eggs to be visible, and are relatively inexpensive to produce. Hence, the consumer may inspect the eggs without having to open the container.

Such containers were developed as a cost-efficient alternative to package eggs and like frangible items. Therefore, it is desirable to optimize all steps from the manufacturing of such containers, to their shipping, and to their use as a container.

SUMMARY OF THE APPLICATION

It is therefore an aim of the present disclosure to provide a packaging configuration and method for stacks of containers.

Therefore, in accordance with the present application, there is provided a package comprising: stacks of empty sheet-formed containers, with each said container being made of a sheet of polymer formed into an open tray comprising a base portion defining at least one receiving cavity, at least one cover portion, and a hinge between the base portion and the cover portion for rotating the cover portion onto the base portion to close the container, each said stack comprising the containers in open trays matingly stacked one into the other; panels each having a main surface with peripheral walls; support members; a first level comprising a first one of the panels at a bottom, at least one said stack of containers laid horizontally on the main surface of the first one of the panels within the peripheral walls, and at least one said support members extending from the first one of the panels to a top of the first level; at least a second level comprising a second one of the panels laid on top of the first level in contact with the support members of the first level, at least another one said stack of containers laid horizontally on the main surface of the second one of the panels within the peripheral walls, and at least one said support members extending from the second one of the panels to a top of the second level; and one said panel on top of an uppermost one of the levels and having its peripheral walls covering a top of the sides of the uppermost one of the levels and in contact with the support members of the uppermost one of the levels.

DESCRIPTION OF THE PREFERRED EMBODIMENTS

Figure 1:
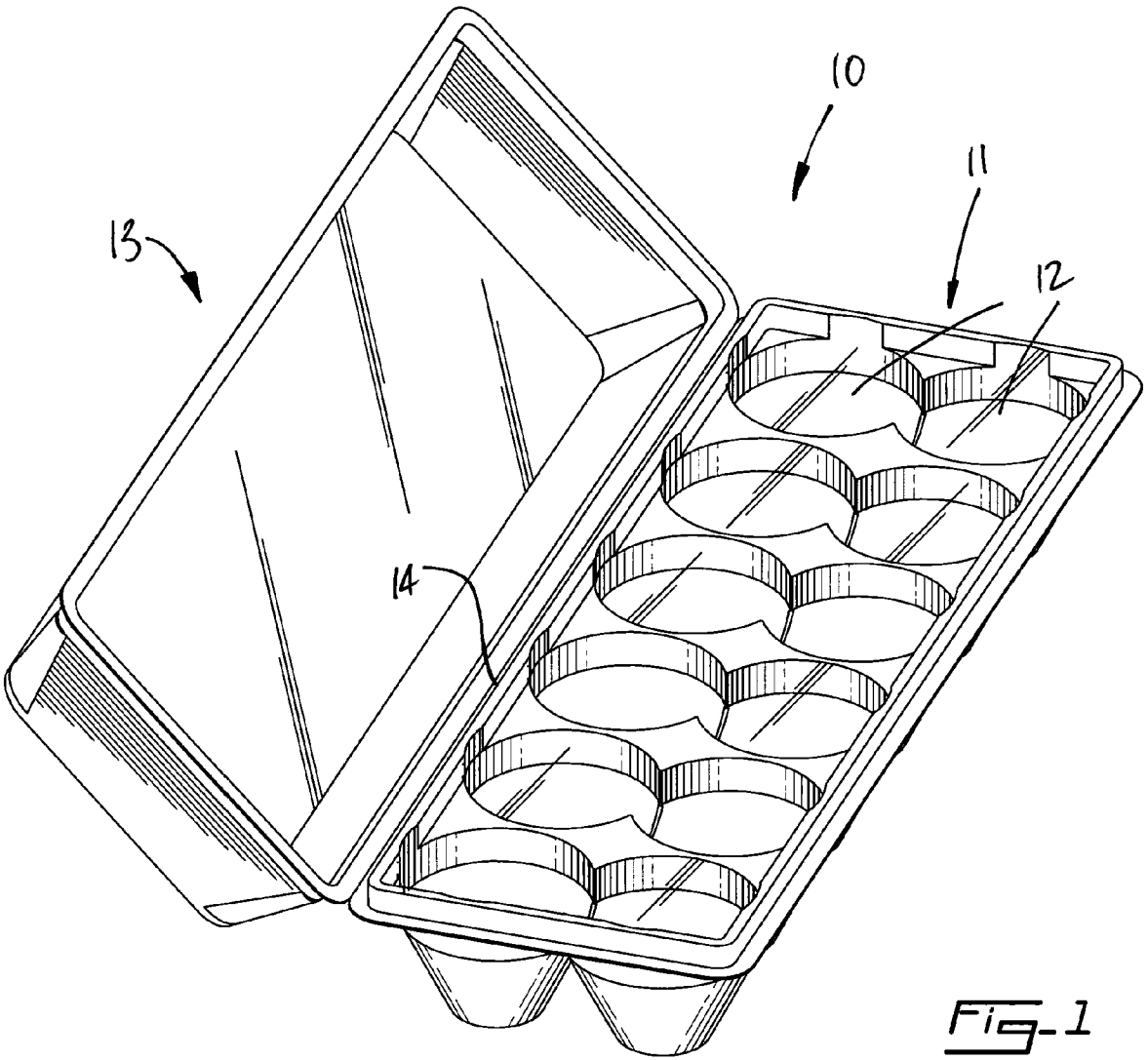
FIG. 1 is a schematic perspective view of a two-fold egg container.

Referring to the drawings and more particularly to FIG. 1, an egg container is generally shown at 10. The egg containers described hereinafter are made of transparent or translucent plastics, for instance using a thermoforming process or other molding process, with a sheet of polymer as starting point. Other materials and/or processes may be used as well. The containers described hereinafter may be used to contain eggs or any other frangible items (e.g., tomatoes).

The egg container 10 of FIG. 1 is a two-fold egg container, as it has two portions hinged to one another. The egg container 10 has a base portion 11 having a plurality of receiving cavities 12 (e.g., six, twelve, eighteen, twenty-four, or any other suitable number), with each cavity 12 receiving an egg. A top cover portion 13 is hinged to the base portion 11 by hinge 14. The top cover portion 13 may or may not have individual cavities to cover a top portion of the eggs supported by the receiving cavities 12. Alternatively, the top cover portion 13 may present a flat top surface as in FIG. 1, with or without strengthening components (e.g., arches, posts). Although not shown, mating connectors or any other suitable type of connectors are provided on the periphery of the base portion 11 and top cover portion 13 for interlocking them when the egg container 10 is closed.

Figure 2:
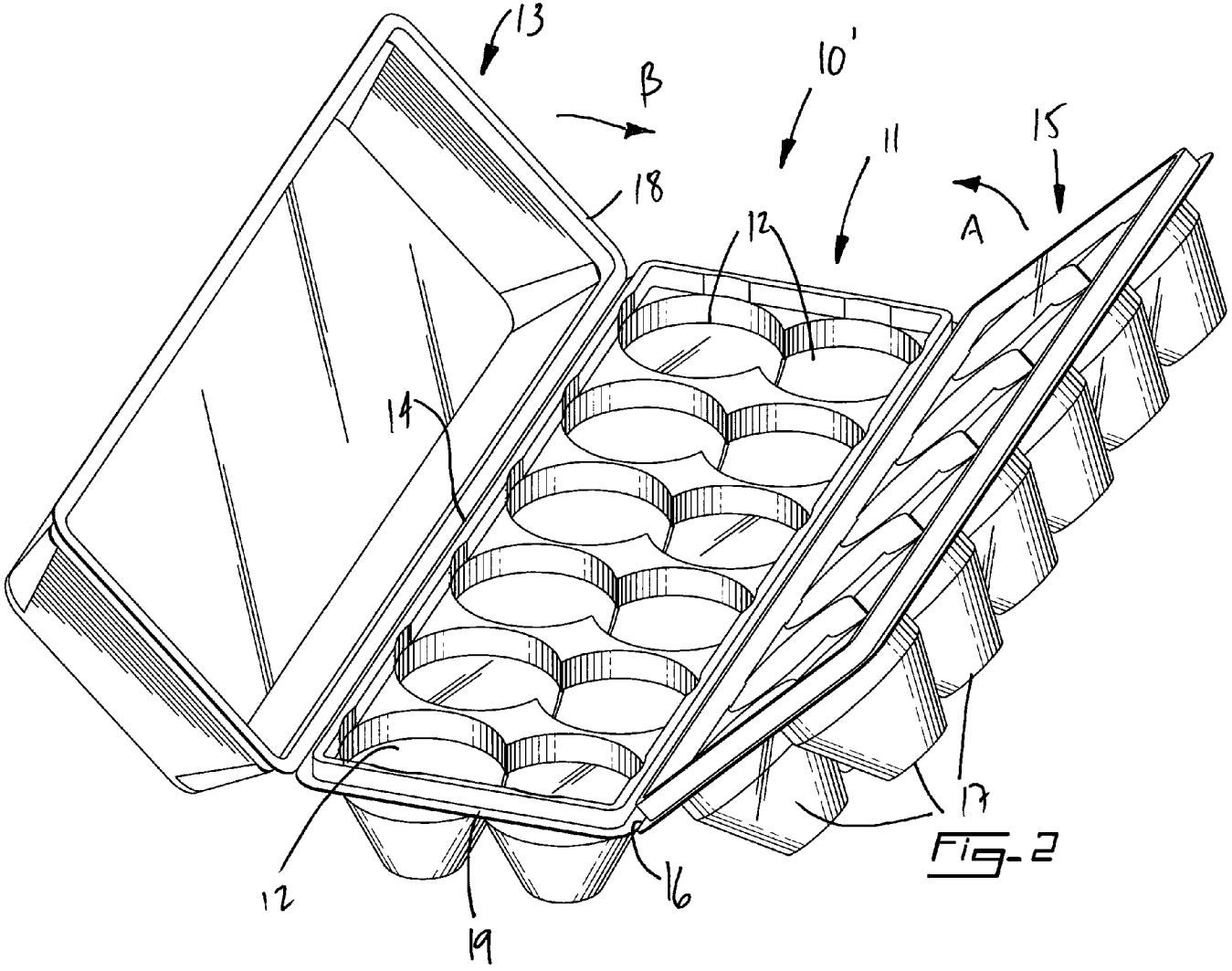
FIG. 2 is a schematic perspective view of a three-fold egg container.

Referring to FIG. 2, a three-fold egg container is generally illustrated at 10'. The egg container 10' is similar to the egg container 10 of FIG. 1, but has a middle cover portion 15. The middle cover portion 15 is hinged to the base portion 11 by hinge 16. The hinges 14 and 16 are preferably on opposite edges of the base portion 11. The middle cover portion 15 typically has egg cavities 17 to cover a top portion of the eggs supported by the egg-receiving cavities 12. Although not shown, mating connectors or any other suitable type of connectors are provided on the periphery of the top cover portion 13 and the middle cover portion 15 for interlocking them when the egg container 10' is closed.

In order to close the egg container 10', the middle cover portion 15 is firstly hinged into contact with the base container 12, as illustrated by arrow A. The top cover portion 13 is then hinged onto the middle cover portion 15, as illustrated by arrow B. When the egg container 10/10' is closed, peripheral flanges 18 and 19 lay flat one on the other.

The egg containers of the present disclosure may contain any suitable number of egg receiving cavities. One suitable material for the egg containers of the present application is polyethylene terephthalate (PET). PET has many advantages, as this material can be transparent or opaque and can be produced at high volume and at low cost. Wall thicknesses of PET cases in a contemplated embodiment are of 0.0175 inch in thickness, but other thicknesses as low as 0.012 to as high as 0.022 inch are also contemplated. It is pointed out that the thickness may be outside of these ranges, especially after the container 10 is formed. However, any suitable thickness can be used, depending on the fragility of the objects packaged in the container 10.

The containers 10 and 10' as in FIGS. 1 and 2 may be stacked when opened (i.e., at the exit of the thermoforming process). When the containers 10 and 10' are opened, they are generally flat. Hence, a bottom container 10 or 10' may be laid on the ground with cavities 12 and 17 (if applicable) facing upwardly (or facing downwardly), and will act as a female container (or male container if facing downwardly) for receiving another container laid thereon. By repeating these steps, a stack of containers 10 or 10' may be formed, to any appropriate height. Due to the thinness of the containers 10 and 10' made from a sheet of thermoformed material, the containers 10 or 10' stacked into one another are separated by a relatively small distance. For instance, the spacing between adjacent containers 10 and 10' of a same stack is between 0.12" and 0.38".

Figure 3:
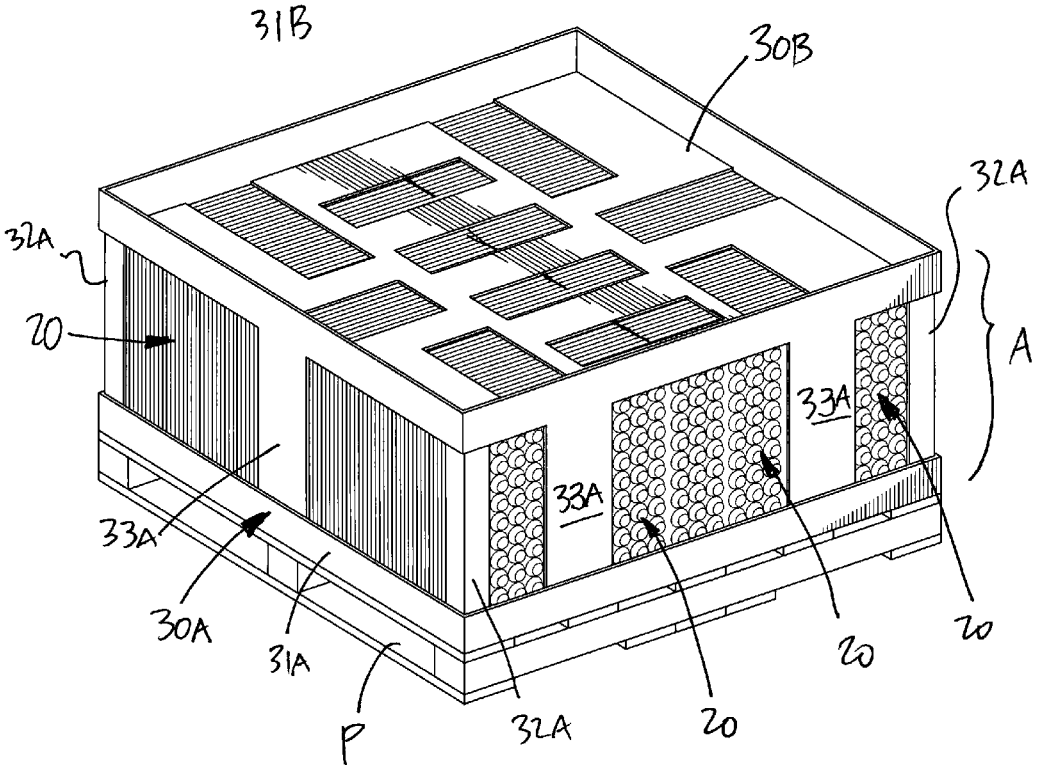
FIG. 3 is a perspective view of one level of a packaging configuration of egg containers of FIGS. 1 and 2.

A first level of a packaging configuration is shown in FIG. 3, as laid on a support platform P, such as a pallet displaced by fork lifts. In the packaging configuration, at least one stack 20 of containers 10/10' is laid on its side, instead of being upright. The stack 20 is laid on its side such that the longitudinal edges passing through the hinges 14 and 16 (if applicable) of FIGS. 1 and 2 are generally normal to a support plane of the platform P, although these longitudinal edges could alternatively be parallel to the support plane of the platform P. In FIG. 3, there are multiple stacks 20 laid side by side, to fully cover the support plane of the platform P. In an embodiment, the stacks 20 do not extend beyond the support platform P. It is also considered to form the stacks 20 having a height determined as a function of the width or other dimension of the support platform P.

Still referring to FIG. 3, a first panel 30A is between the support platform P and a first level A of stacks 20, while a second panel 30B is on top of the first level A of stacks 20. The panels 30 (i.e., 30A, 30B, etc) are made of any appropriate material, and are shown as being in corrugated cardboard or like fiberboard. The panels 30, such as panel 30A, have a peripheral wall 31 on its four sides, to cover a bottom portion of the horizontal stacks 20, or top portion if inverted. Corner members 32, for instance shaped as right-angle brackets, project upwardly from the corners of the first level A, so as to protect these corners. The corner members 32 are made of the same material as the panels 30, as they may be cut out from these panels 30, as explained hereinafter. Side members 33 extend from one panel 30 to another, and are on side faces of the bundle being formed. In FIG. 3, there is illustrated a configuration using six of the side members 33 (three being visible), although more or less of these side members 33 could be used. The side members 33 may be integrally connected to a respective panel 30 as explained hereinafter, and act as support columns, to strengthen the bundle being formed. Hence, at least some of the side members are positioned such that corrugations (a.k.a., flutes) are vertical.

Figure 4:
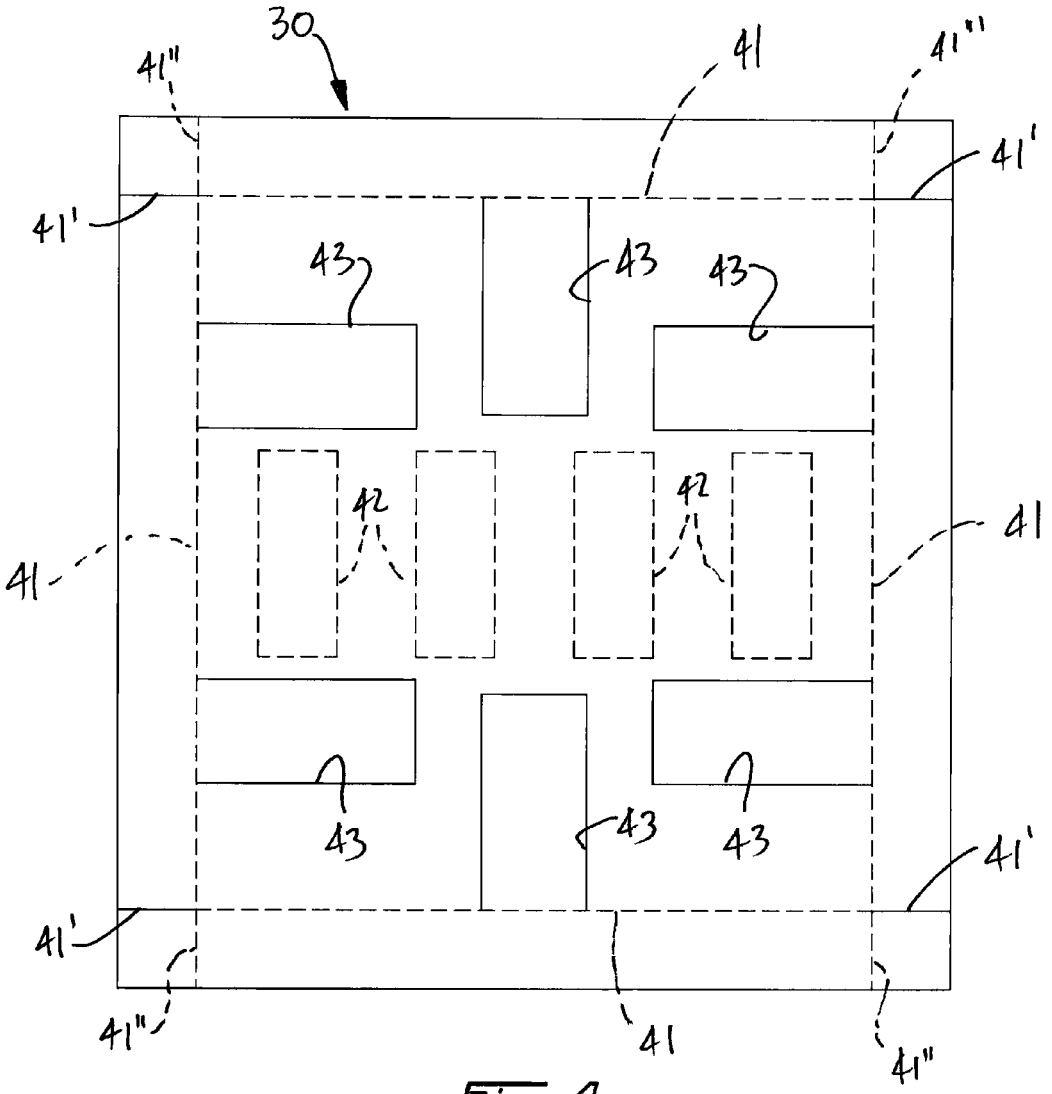
FIG. 4 is a plan view of a packaging panel of the packaging configuration of FIG. 3.

Referring to FIG. 4, there is illustrated one embodiment of the panel 30 that may be used as either one of the panel 30A and the panel 30B of FIG. 3. The panel 30 has a main rectangular surface delimited by fold lines 40. The main rectangular surface is typically sized to the same dimensions at the support plane of the support platform P (and hence may be square among other possibilities).

The fold lines 40 are used to form the peripheral wall 31 (FIG. 3). For instance, the fold lines 40 may be preformed in the panel 30 by any appropriate method. Sets of a slit 41' and a fold line 41" are defined at each intersection between the fold lines 40 to create a tab, and hence represent one arrangement among others to interconnect adjacent peripheral walls 31 in such a way that the peripheral walls 31 remain vertical. An adhesive or mechanical fastener (staples) may be used to secure the tab of one peripheral wall 31 to the adjacent peripheral wall 31.

Rectangles 42 of pre-perforated lines are present in the main rectangular surface of the panel 30, and are to be torn off from the panel 30 and serve as the corner members 32. The pre-perforated lines of the rectangles 42 may be formed in the panel 30 in any appropriate manner. Alternatively, the rectangles 42 may simply be visual indications guiding an operator in cutting these shapes out of the panel 30.

Sets 43 of three pre-perforated or pre-cut lines are also present in the main rectangular surface of the panel 30 and each intersect with a respective one of the fold lines 40. Hence, flaps are formed as hinged to the main surface of the panel, using the sets 43 to separate the flap from the main panel. These flaps define the side members 33 shown in FIGS. 3 and 5. The pre-perforated or pre-cut lines of the sets 43 may be formed in the panel 30 in any appropriate manner. According to an embodiment, the sets 43 are positioned as a function of the corrugations, for instance to have as many of the side members 33 having the corrugations vertical.

Figure 6:
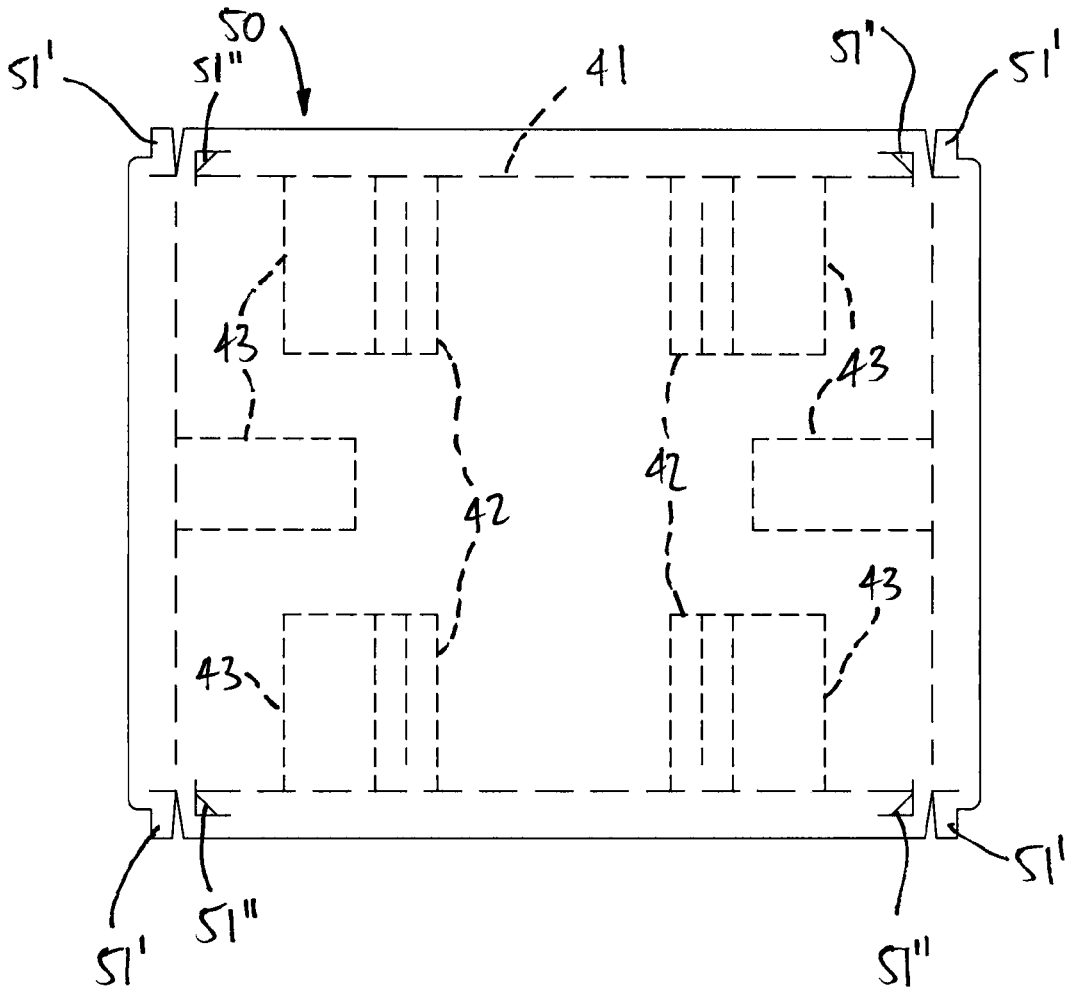
FIG. 6 is a plan view of a variant of the packaging panel of FIG. 4.

Referring to FIG. 6, there is illustrated at 50 a variant of the panel 30 of FIG. 4, whereby like elements will bear like reference numerals. The panel 50 has the rectangles 42 of pre-perforated lines adjacent to the sets 43 of three pre-perforated or pre-cut lines, with the rectangles 42 being removable therefrom to be positioned in the corners of the bundles. It is observed that the corners of the panel 50 each have a set of a tab 51' and slit 51". The tab 51' may be inserted in its corresponding slit 51" to form the peripheral wall that will be at a right angle with the main surface of the panel 50. The combination of the tab 51' and slit 51" may be sufficient to form the peripheral wall, in that no other fastening means (i.e., adhesive, tape, staples) may be required, although such fastening means could nonetheless be used. The rectangles 42 may be provide with a fold line 52 to guide in folding same to a right angle. The fold line 52 may be a weakened line (e.g., with perforations) die cut in the panels 30 and/or 50.

Now that the panels 30 have been described, a method for making bundles of egg containers 10/10' is set forth.

Figure 5:
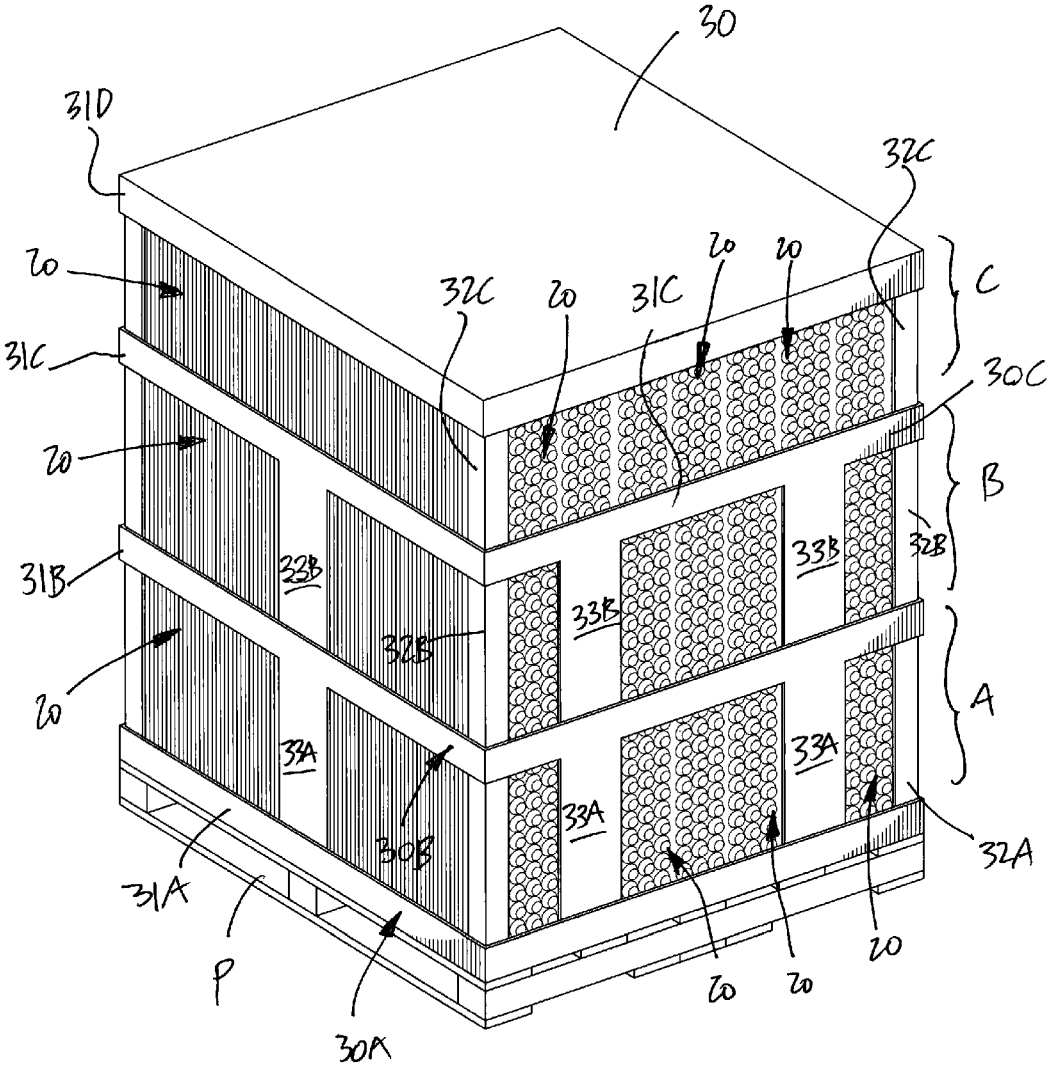
FIG. 5 is a perspective view of multiple levels of a packaging configuration of egg containers of FIGS. 1 and 2.

Referring to FIGS. 3 and 5, a first panel 30A is laid on support surface of the support platform P. The first panel 30A has been assembled to at least define the peripheral walls 31. According to an embodiment, the side members 33 may be deployed and hinged to project upwardly from the panel 30A. According to another embodiment, the corner members 32 may be torn off or removed from the panel 30A as well. According to another embodiment, the side members 33 of the panel 30B may be deployed and hinged to project downwardly from the panel 30B, as shown in FIG. 3, to be used in level A. In the illustrated embodiment, the corner members 32B may be torn off or removed from the panel 30B, to be used in level A as well.

Thereafter, the stacks 20 may be laid onto the top surface of the panel 30A. Adjacent stacks 20 may be oriented in opposite directions (i.e., one stack 20 having the top surface of the containers 10/10' facing in one direction, a subsequent stack 20 having the top surface of the containers 10/10' facing in the other direction), as alternating orientations may strengthen the stacks 20 against tilting. As mentioned previously, the stacks 20 have a predetermined height to fit appropriately in the concavity defined by the peripheral walls 31. According to another embodiment, a height of the stacks 20 is adjusted to reach an appropriate stack height, by removing or adding some containers 10/10'.

Referring concurrently to FIGS. 3 and 5, the panel 30B may then be added, by being laid onto the top of the horizontal stacks 20. If the side members 33 of the panel 30A have been deployed, the side members of the panel 30B are hinged to project upwardly from the panel 30A. To the contrary, if the side members 33 of the panel 30A have not been deployed, the side members of the panel 30B are hinged to project downwardly from the panel 30B, to have their ends abut against the top surface of the main surface of the panel 30A. The corner members 32 must then be positioned against the corners of the stacks 20. The corner members 32 may first be folded to forma right angle. Then, an end of each of the corner members 32 is inserted in the gap between the peripheral walls 31 and the stacks 20.

These steps are repeated to add additional levels, such as shown as B, C, etc, in FIG. 5. In the end, a panel 30X (shown as 30D) is inserted with the peripheral walls 31 facing downwardly, to cover the top of the bundle. It is noted that the side members 33 need not be deployed to provide structural support, as there is no additional level to be supported. A plastic film may then be wrapped around the lateral surfaces of the bundle to protect the egg containers 10/10' from dust, etc. The plastic film may provide additional strength to the bundle.

It is pointed out that the corner members 32 and the side members 33 may come separate from the panels 30, instead of bring pre-cut or pre-perforated therein.

The invention claimed is:

1. A package configuration for stacking a plurality of containers, the package configuration having a plurality of panels, each panel comprising:

a main surface;

a peripheral wall foldably joined to the main surface and defining a perimeter and corners of the panel;

a plurality of corner members each disposed proximate one of the corners and extending substantially perpendicular to the main surface, each corner member formed from a removable portion of the panel; and at least one side support member spaced along the perimeter from at least one of the plurality of corner members, the at least one side support member foldably joined to the main surface, wherein the corner members each extend from the panel to a corresponding corner of an adjacent panel of the package configuration.

2. The package configuration according to claim 1, wherein the at least one side support member is hinged to extend upwardly from the main surface of the panel.

3. The package configuration according to claim 1, wherein the at least one side support member is hingedly joined to the main surface of the panel.

4. The package configuration according to claim 1, wherein the at least one side support member is hinged to extend downwardly from the main surface of the panel.

5. The package configuration according to claim 1, wherein the at least one side support member comprises a side support member disposed on each side of the main surface of the panel.

6. The package configuration according to claim 1, wherein the plurality of containers comprises at least two stacks of containers.

7. The package configuration according to claim 6, wherein the at least two stacks are oriented in opposite directions when laid horizontally.

8. The package configuration according to claim 6, wherein the stacks are positioned such that a hinge of each container of the stack is normal to a plane of the main surface of the panel.

9. The package configuration according to claim 1, wherein the panels are formed from corrugated cardboard.

10. The package configuration according to claim 1, wherein the at least one side support member is hingedly joined to the panel, the at least one side support member being pre-perforated in the main surface of the panel.

11. The package configuration according to claim 9, wherein the at least one side support member is hingedly joined to the panel, the at least one side support member positioned such that flutes of the corrugated cardboard are vertical in the package configuration.

12. The package configuration according to claim 1, wherein each of the plurality of containers further comprise: two cover portions, an intermediate one of the cover portions having item covering cavities;

a first hinge proximate a first longitudinal edge, and an opposing second hinge, the second hinge disposed between a second longitudinal edge of the base portion, and the intermediate cover portion hingedly configured to cover the base portion, a top one of the cover portions being hinged about the first longitudinal edge to secure the base portion, the intermediate cover portion and the top cover portion in a closed configuration.

13. A package configuration for stacking a plurality of containers, the package configuration having a plurality of panels, each panel comprising:

a main surface;

a peripheral wall foldably joined to the main surface and defining a perimeter and corners of the panel;

a plurality of corner members each disposed proximate one of the corners and extending substantially perpendicular to the main surface, each corner member formed from a removable portion of the panel; and at least one side support member spaced along the perimeter from at least one of the plurality of corner members, the at least one side support member foldably joined to the main surface, wherein the corner members are formed from pre-perforated cutouts from the main surface of the panel.

14. The package configuration according to claim 13, wherein the at least one side support member is hingedly joined to the main surface of the panel.

15. The package configuration according to claim 13, wherein the at least one side support member is hinged to extend downwardly from the main surface of the panel.

16. The package configuration according to claim 13, wherein the at least one side support member comprises a side support member disposed on each side of the main surface of the panel.

17. The package configuration according to claim 13, wherein the plurality of containers comprises at least two stacks of containers.

18. The package configuration according to claim 17, wherein the at least two stacks are oriented in opposite directions when laid horizontally.

19. The package configuration according to claim 17, wherein the stacks are positioned such that a hinge of each container of the stack is normal to a plane of the main surface of the panel.

20. The package configuration according to claim 13, wherein the at least one side support member is hingedly joined to the panel, the at least one side support member being pre-perforated in the main surface of the panel.

* * * * *